US009220933B2

(12) United States Patent
Bongiorno, Jr.

(10) Patent No.: US 9,220,933 B2
(45) Date of Patent: Dec. 29, 2015

(54) COMBINATION MANIFOLD AND DETERGENT HOLDING RESERVOIR FOR COMMUNICATING WITH A FIRE EXTINGUISHER NOZZLE

(71) Applicant: Benedict Bongiorno, Jr., Washington, MI (US)

(72) Inventor: Benedict Bongiorno, Jr., Washington, MI (US)

( * ) Notice: Subject to any disclaimer, the term of this patent is extended or adjusted under 35 U.S.C. 154(b) by 0 days.

(21) Appl. No.: 14/472,531

(22) Filed: Aug. 29, 2014

(65) Prior Publication Data

US 2015/0060093 A1 Mar. 5, 2015

Related U.S. Application Data

(60) Provisional application No. 61/871,715, filed on Aug. 29, 2013.

(51) Int. Cl.

| | |
|---|---|
| ***A62C 5/02*** | (2006.01) |
| ***A62C 13/00*** | (2006.01) |
| ***A62C 13/72*** | (2006.01) |

(52) U.S. Cl.
CPC . *A62C 13/72* (2013.01); *A62C 5/02* (2013.01); *A62C 5/022* (2013.01)

(58) Field of Classification Search
CPC ..... A62C 5/002; A62C 5/02; A62C 5/022; A62C 13/62; A62C 13/64; A62C 13/72; A62C 13/76
See application file for complete search history.

(56) References Cited

U.S. PATENT DOCUMENTS

| | | | | |
|---|---|---|---|---|
| 2,908,334 | A * | 10/1959 | Duggan et al. | 169/44 |
| 4,359,096 | A * | 11/1982 | Berger | 169/44 |
| 4,805,700 | A * | 2/1989 | Hoover | 169/15 |
| 5,409,067 | A | 4/1995 | Esposito et al. | |
| 5,445,226 | A * | 8/1995 | Scott et al. | 169/15 |
| 5,996,700 | A * | 12/1999 | Sulmone | 169/15 |
| 6,189,625 | B1 * | 2/2001 | Hopkins | 169/88 |
| 6,543,547 | B2 | 4/2003 | Neumeir et al. | |
| 6,561,281 | B1 | 5/2003 | Arnold | |
| 7,080,695 | B2 | 7/2006 | Gwak | |
| 2006/0131034 | A1 | 6/2006 | Lahouati | |
| 2006/0157258 | A1 | 7/2006 | Lin | |
| 2007/0137716 | A1 * | 6/2007 | Stoops et al. | 137/893 |
| 2009/0188681 | A1 | 7/2009 | Chang | |
| 2011/0214885 | A1 | 9/2011 | Mauney | |
| 2011/0259615 | A1 | 10/2011 | von Blucher | |
| 2011/0308821 | A1 | 12/2011 | Katsuraku | |
| 2013/0220651 | A1 * | 8/2013 | Rachidi et al. | 169/85 |

FOREIGN PATENT DOCUMENTS

| | | | |
|---|---|---|---|
| DE | 202005010596 | U1 | 9/2005 |
| DE | 102006026197 | A1 | 12/2006 |
| DE | 102005031451 | A1 | 1/2007 |

(Continued)

*Primary Examiner* — Darren W Gorman
(74) *Attorney, Agent, or Firm* — Dinsmore & Shohl LLP; Douglas J. McEvoy

(57) ABSTRACT

An assembly for mixing and metering a foaming agent with a pressurized fluid output of a fire extinguisher, the extinguisher including a body with a trigger for issuing the fluid through an outlet. The assembly includes a manifold adapted to being attached at an inlet end to the extinguisher outlet, the manifold having an outlet end which is adapted to engage with an inlet of a flexible hose. A canister contains a volume of a fire retardant (dry or foaming) agent and is engaged to an intermediate location of the manifold between the inlet and outlet. In this manner, the manifold mixes the foaming agent with the fluid output prior to delivery through the hose.

5 Claims, 8 Drawing Sheets

(56) References Cited

FOREIGN PATENT DOCUMENTS

| | | | |
|---|---|---|---|
| EP | 1695743 | A1 | 8/2006 |
| EP | 1932566 | A1 | 6/2008 |
| FR | 2670389 | A1 | 6/1992 |
| GB | 2322298 | A | 8/1998 |
| WO | 2008043344 | A2 | 4/2008 |

* cited by examiner

FIG. 5
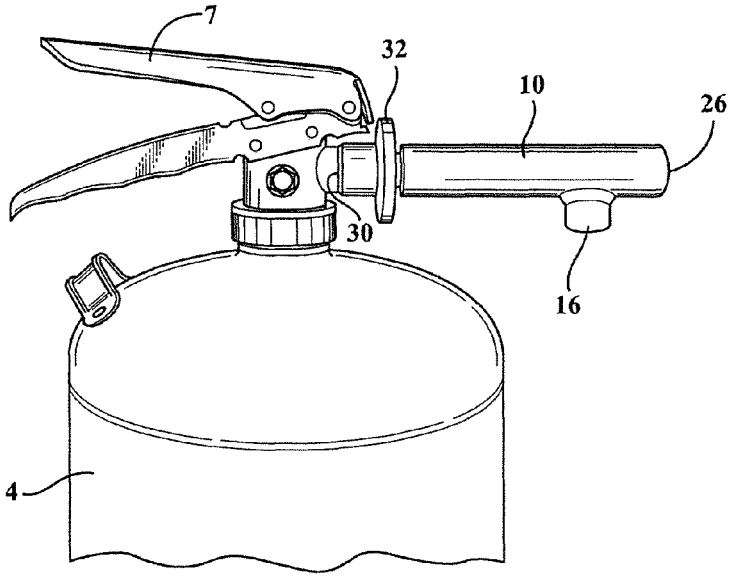
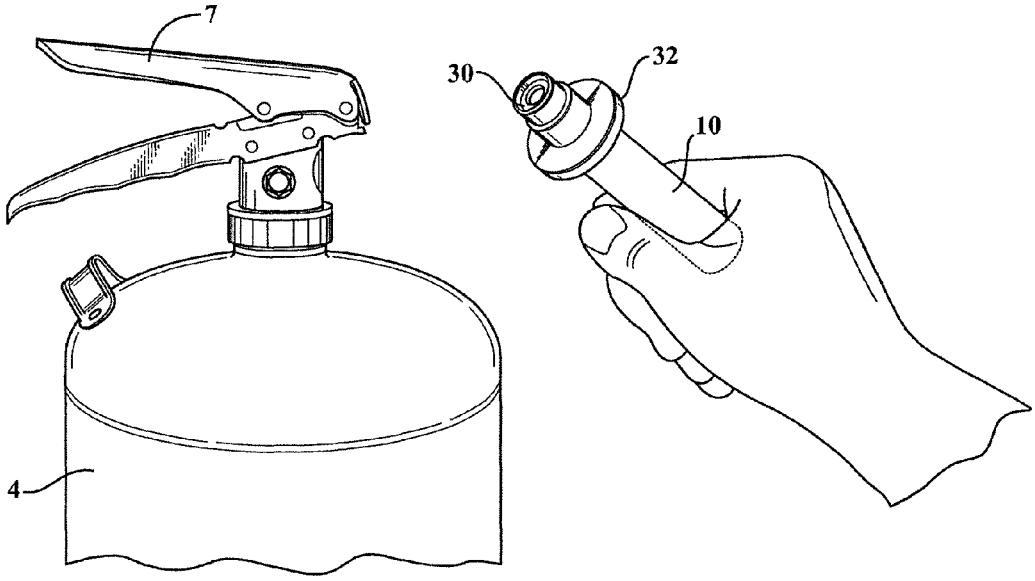
FIG. 6

COMBINATION MANIFOLD AND DETERGENT HOLDING RESERVOIR FOR COMMUNICATING WITH A FIRE EXTINGUISHER NOZZLE

CROSS-REFERENCE TO RELATED APPLICATIONS

This Application claims the benefit of U.S. Provisional Application No. 61/871,715 filed on Aug. 29, 2013, the contents of which are incorporated herein in its entirety.

FIELD OF THE INVENTION

The present invention relates generally to fire extinguisher technology, such as most typically associated with a standard 2.5 gallon and 100 psi rated fire extinguisher, and with which often mixed a conventional foaming agent such as known as Fire Ade, AFFF, fire foam or the like. More specifically, the present invention discloses an attachment and mixing manifold which connects between the threaded outlet of the fire extinguisher and the extending hose, this in combination with a foam agent filled canister attachable to the manifold. The canister is typically a smaller sized (refillable or disposable) reservoir containing the foaming agent at a pressurization similar to that of the fire extinguisher. The mixing manifold may optionally incorporate an adjustment valve or other Venturi effect configuration (which enables a reduction in fluid pressure resulting from fluid flowing through a constricting conduit section in the mixing manifold) and in order to efficiently and cost effectively mix and dispense a combination of pressurized water and expensive foaming agent. The ability to provide the foaming agent as a separate attachable canister is an improvement over conventional refilling protocols associated with a standard fire extinguisher, usually requiring refilling/adding of the mixture by the manufacturer, and provides significant cost savings.

BACKGROUND OF THE INVENTION

The prior art is well documented with examples of attachment and mixing devices utilized with a fire extinguisher. Related references DE 10 2005 031 451 and DE 20 2005 010 596 teach an additive agent holding container 23 which is arranged outside of the conventional extinguisher and is depicted mounted to a mixing mechanism associated with an extending end of the flexible hose 13. Variants of the extinguisher can also include an interiorly disposed CO2 cartridge 19 in order to maintain pressurization within the main tank.

Neumeir, U.S. Pat. No. 6,543,547, teaches a portable foam fire extinguisher with pressurized foam stabilization including a container 6 for the fire extinguisher medium, a pressurized gas bottle 7 in communication with the container, and a fire extinguisher gun connected to the container by a hose for supplying the fire extinguishing to the fire extinguisher gun. A mixing device is connected by way of a pressure hose to the pressurized gas bottle for admixing pressurized gas to the flow of the fire extinguishing medium to the fire extinguisher gun.

Both EP 1 695 743 and FR 2 670 839 teach an additive holding body or container 11 which is arranged within an extinguisher interior. Chang, US 2009/0188681, teaches a container 40 holding a dry chemical agent and which is incorporated into a cover 20 forming an integral portion of a fire extinguisher (FIG. 3) and including a check valve 47 for introducing the agent for mixing within the interior 11 of the extinguisher.

SUMMARY OF THE INVENTION

The present invention teaches an assembly for mixing and metering a foaming agent with a pressurized fluid output of a conventional fire extinguisher, the extinguisher including a body with a trigger for issuing the fluid through an outlet. The assembly includes a manifold adapted to being attached at an inlet end to the extinguisher outlet, the manifold having an outlet end which is adapted to engage with an inlet of a flexible hose.

A canister containing a volume of a foaming agent is engaged to an intermediate location of the manifold between the inlet and outlet, the manifold mixing the foaming agent with the fluid output prior to delivery through the hose. In one non-limiting variant, the canister further includes a disposable can internally pre-pressurized to a level commensurate with the extinguisher.

The extinguisher outlet typically exhibits an internally threaded aperture, the manifold further exhibiting an attachment engaged with the inlet end thereof and further adapted to engage the internally threaded aperture of the extinguisher. In a further variant, the attachment includes a tightening knob.

The manifold and further include an underside threaded aperture corresponding to the intermediate attachment location of the canister, which can further have a mating threaded attachment for securing to the manifold. In a further variant, the canister can incorporate a valve for metering a volume of foaming agent intermixed within the manifold with the pressurized fluid outlet from the extinguisher.

BRIEF DESCRIPTION OF THE DRAWINGS

Reference will now be made to the attached drawings, when read in combination with the following detailed description, wherein like reference numerals refer to like parts throughout the several views, and in which:

FIG. 5 is an illustration of the mixing manifold component only engaged with the extinguisher outlet attachment;

FIGS. 6 and 7 are succeeding illustrations with the manifold mixing attachment removed from the extinguisher;

DETAILED DESCRIPTION OF THE PREFERRED EMBODIMENTS

Figure 1:
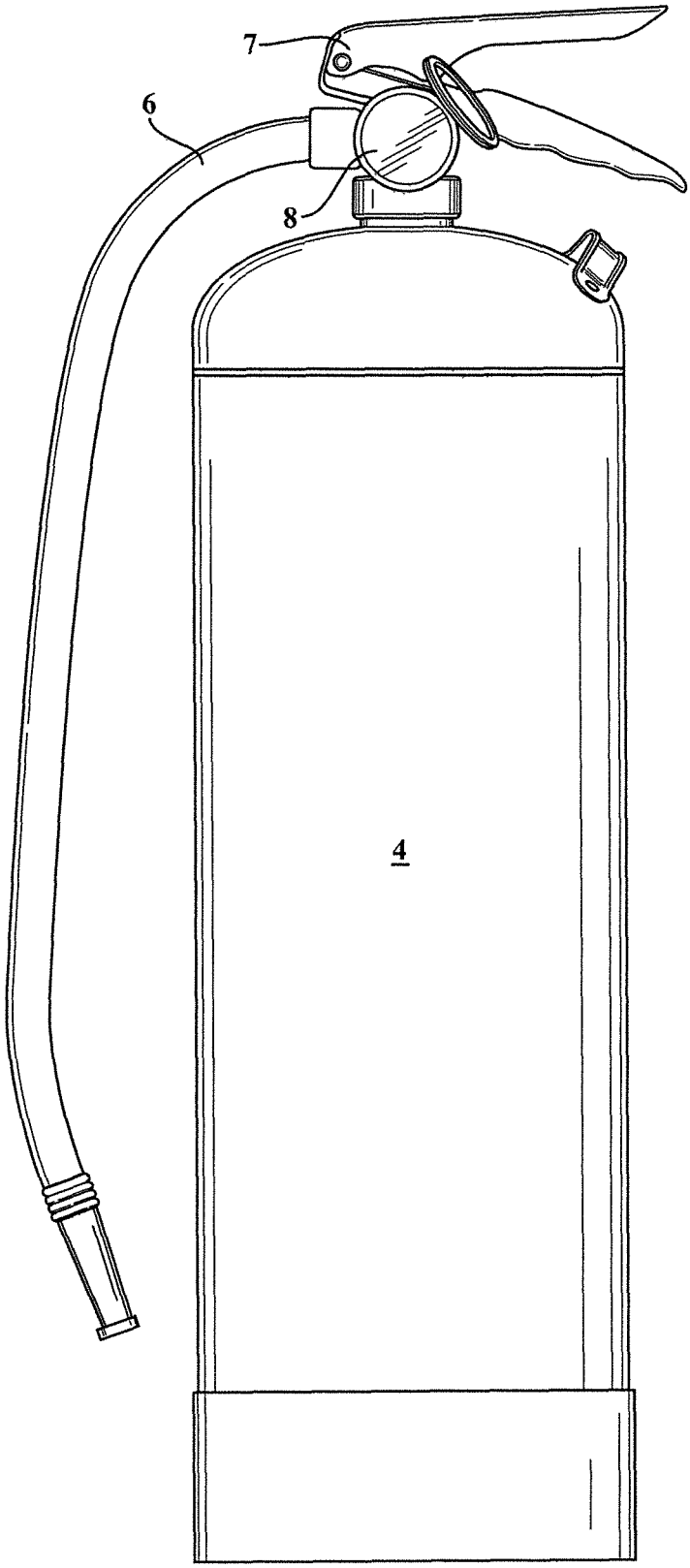
FIG. 1 PRIOR ART
FIG. 1 is a Prior Art illustration of a conventional fire extinguisher and including pressurized fluid filled tank, pressurization gage and compressible dispensing valve and outlet hose.

As previously described, the present invention is directed to fire extinguisher technology, such as most typically associated with a standard 2.5 gallon and 100 psi rated fire extinguisher, and with which often mixed a conventional foaming agent such as known as Fire Ade, AFFF, fire foam or the like. As is known in the common art, such foaming agents are typically applied to fuel fires as either an aspirated (mixed & expanded with air in a branch pipe) or non-aspirated form to form a frothy blanket or seal over the fuel, preventing oxygen reaching it. Unlike powder, foam based agents extinguish by separating the four parts of the fire tethrahedron, such foam agents being used to progressively extinguish fires without flashback.

Among known foam agents are the following:

AFFF (aqueous film forming foam), used on A and B fires and for vapor suppression. The most common type in portable foam extinguishers. It contains fluoro tensides which can be accumulated in the human body. The long-term effects of this on the human body and environment are unclear at this time.

AR-AFFF (Alcohol-resistant aqueous film forming foams), used on fuel fires containing alcohol. Forms a membrane between the fuel and the foam preventing the alcohol from breaking down the foam blanket.

FFFP (film forming fluoroprotein) contains naturally occurring proteins from animal by-products and synthetic film-forming agents to create a foam blanket that is more heat resistant than the strictly synthetic AFFF foams. FFFP works well on alcohol-based liquids and is used widely in motorsports.

CAFS (compressed air foam system) Any APW style extinguisher that is charged with a foam solution and pressurized with compressed air. Generally used to extend a water supply in wildland operations. Used on class A fires and with very dry foam on class B for vapor suppression.

Arctic Fire is a liquid fire extinguishing agent that emulsifies and cools heated materials more quickly than water or ordinary foam. It is used extensively in the steel industry. Effective on classes A, B, and D.

Fire Ade is a foaming agent that emulsifies burning liquids and renders them non-flammable. It is able to cool heated material and surfaces similar to CAFS. Used on A and B (said to be effective on some class D hazards, although not recommended due to the fact that fireade still contains amounts of water which will react with some metal fires).

As is known in the common art, such foaming agents are typically mixed directly with the water contained within the extinguisher. Without limitation, one desired mixing ratio of water with Fire Ade agent contemplates a desired mixing ratio of 9.4 ounces of foaming agent per 2.5 gallon fire extinguisher. Given the high cost of typical foaming agents (often hundreds of dollars per gallon) overfilling beyond the desired mixing ratio can be very costly, as well as often without any significant increase in effectiveness of the mixture to be dispensed.

Premixing of the foaming agent directly with the extinguisher water base can also provide the undesirable effect of settling of the agent at the bottom of the can (with a decrease in effectiveness). Mixing of the agent and extinguisher water base, without use of the extinguisher within a reasonable time frame, can also potentially cause deleterious effects to the operability of the extinguisher and its built in valving and, for these reasons, extinguisher manufacturers often require (for warranty and other purposes) that the foaming agent not be applied directly within the extinguisher in direct combination with the water base.

Given the above, the present invention is intended as an improvement over the prior art techniques and discloses an attachment and mixing manifold, generally shown at 10, and which connects between a threaded outlet 2 (FIG. 13) of a fire extinguisher 4 and an associated threaded inlet 3 of an extending hose 6. As is known, the fire extinguisher also includes a compressible trigger/valving construction 7 and integrated pressure display 8.

Figure 2:
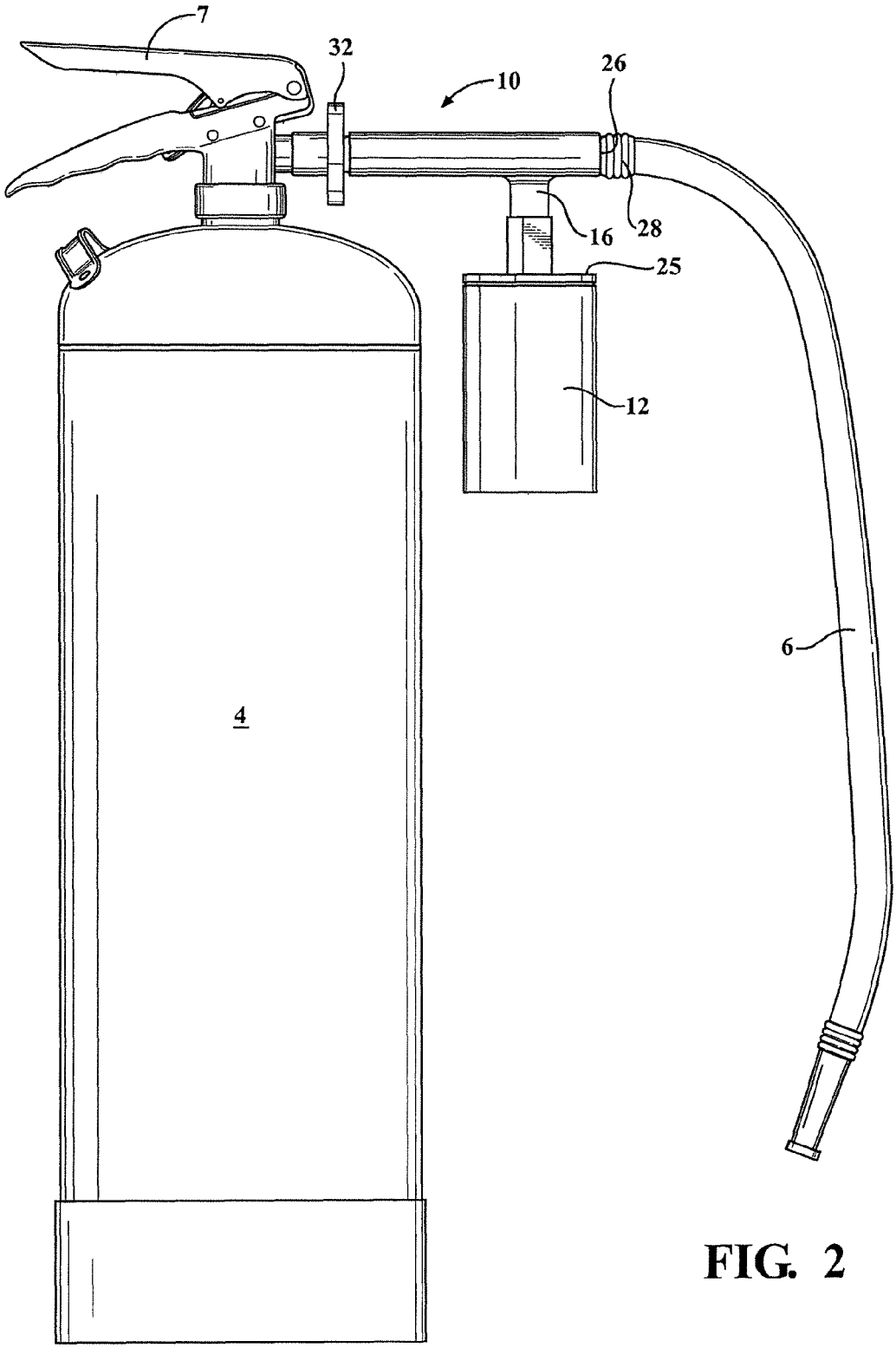
FIG. 2 is a similar illustration of the combination mixing manifold and attachable foam agent canister for attachment to the threaded dispensing outlet of the extinguisher according to one non-limiting embodiment of the present application.
Figure 9:
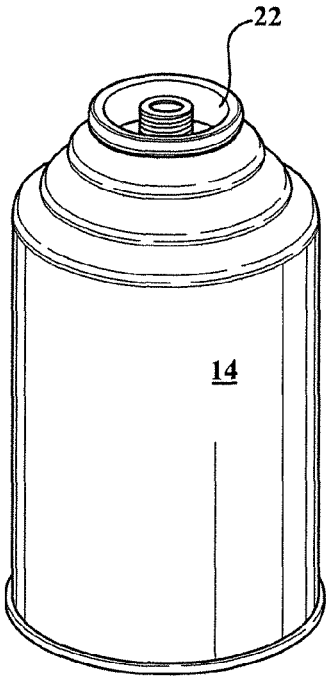
FIG. 9 is an illustration of a pressurized canister according to a further embodiment and which can be prefilled with a suitable foaming agent and, optionally, pressurized to an approximate equal value as compared to the contents of the fire extinguisher, the illustration further exhibiting a frangible top seal of the canister which facilitates attachment to the mixing manifold without resulting loss of internal pressurization.
Figure 10:
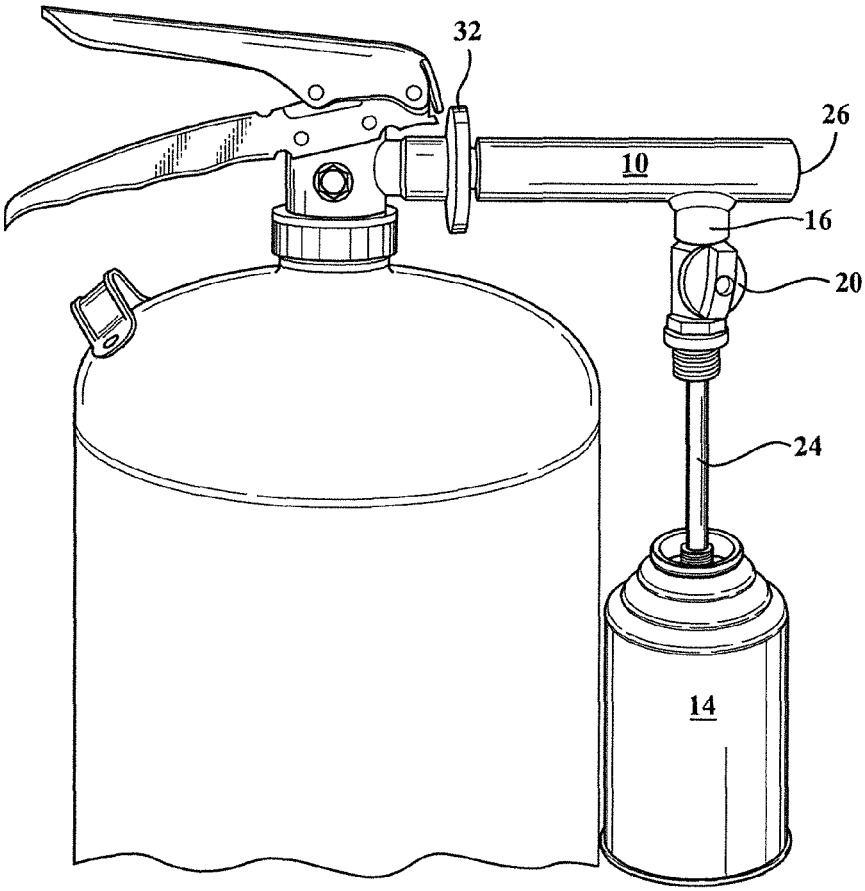
FIG. 10 is an illustration of a semi-installation step associated with a pressurized foam agent canister in combination with an attachment and withdrawal valve for communicating with the mixing manifold.

The manifold 10 is provided in combination with a foam agent filled canister, this being depicted at 12 in FIG. 2 et seq. as a refillable container, but also understood to include a prefilled and, typically, disposable canister 14 as shown in FIGS. 9-10. The disposable variant 14 can, without limitation, include a pre-filled 9.4 oz of suitable foaming agent which is also optionally pre-pressurized (such as at 100 psi) in order to equal the internal pressurization of the extinguisher 4. The canister 12 or 14 is attachable to the manifold 10, such as by threadably engaging to an underside projecting and interiorly threaded location 16 associated with the manifold.

FIG. 10 best illustrates the canister 12 with an exteriorly threaded upper end 18 which rotatably inter-engages the interiorly threaded location 16 associated with the manifold underside. A valve 20 or suitable metering structure can be integrated into either version of the canister 12 or 14 (or relocated to the underside engaging location 16 of the manifold 10) and in order to provide for correct admixing of foaming agent with the pressurized water being dispensed through the manifold from the extinguisher. As is further understood, the provision of the valve 20, and/or the pressurization of either the refillable or disposable canister versions, can be optional in instances in which the Venturi effect of the foaming agent entrained fluid is withdrawn from the canister in a calibrated manner to optimize the desired admixture with the pressurized fluid being concurrently discharged from the extinguisher.

Figure 4:
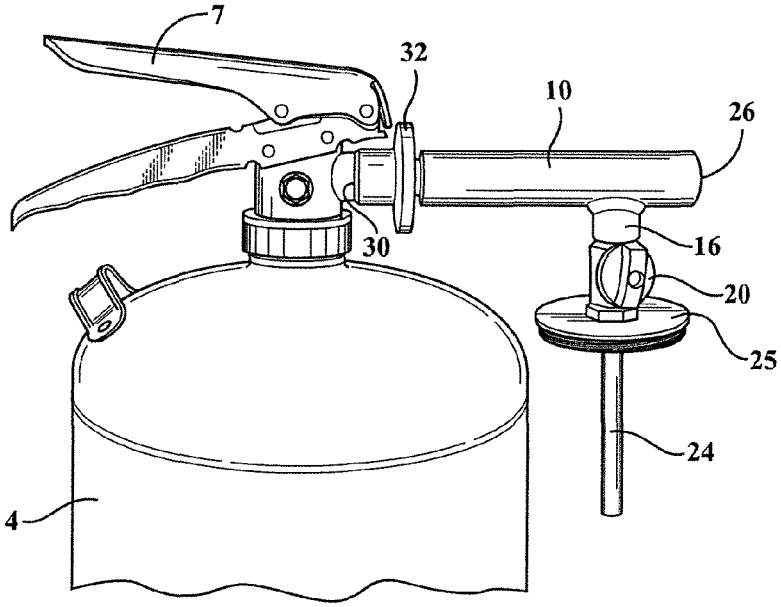
FIG. 4 is a succeeding illustration illustrating a mixing valve associated with the foam agent dispensing canister and which illustrates the canister removed.

As further described in FIGS. 9-10, the pressurized and disposable canister 14 variant further illustrates a frangible top seal 22 (FIG. 9) which facilitates attachment to the mixing manifold without resulting loss of internal pressurization. This is further shown in FIG. 10 in an illustration of a semi-installation step associated with a pressurized foam agent canister 14 in combination with an attachment and withdrawal valve (knob portion 20 of which being understood to designate the overall valve and to communicate with any suitable gate or valving structure for opening or closing fluid flow from an extending stem 24 in communicating fashion with the mixing manifold 10). In comparison, FIG. 4 illustrates a similarly configured stem 24 integrated into a threaded lid 25 which is configured for attaching to a cylindrical main body 12 associated with the refillable canister variant of FIG. 2.

As with the refillable variant 12 of foam agent canister, the disposable variant 14 can likewise be readily pressurized to match that of the extinguisher interior and can include any necessary attachment structure include interiorly/exteriorly threaded nipples, push and twist tab and slot variants with built in washer seals or other like structure for readily attaching to the manifold without comprising internal pressurization of the canister. As also previously described, the mixing manifold may further incorporate either of an adjustment valve or other Venturi effect configuration (which enables a reduction in fluid pressure resulting from fluid flowing through a constricting conduit section in the mixing manifold) and in order to efficiently and cost effectively mix and dispense a combination of pressurized water and expensive foaming agent.

Figure 3:
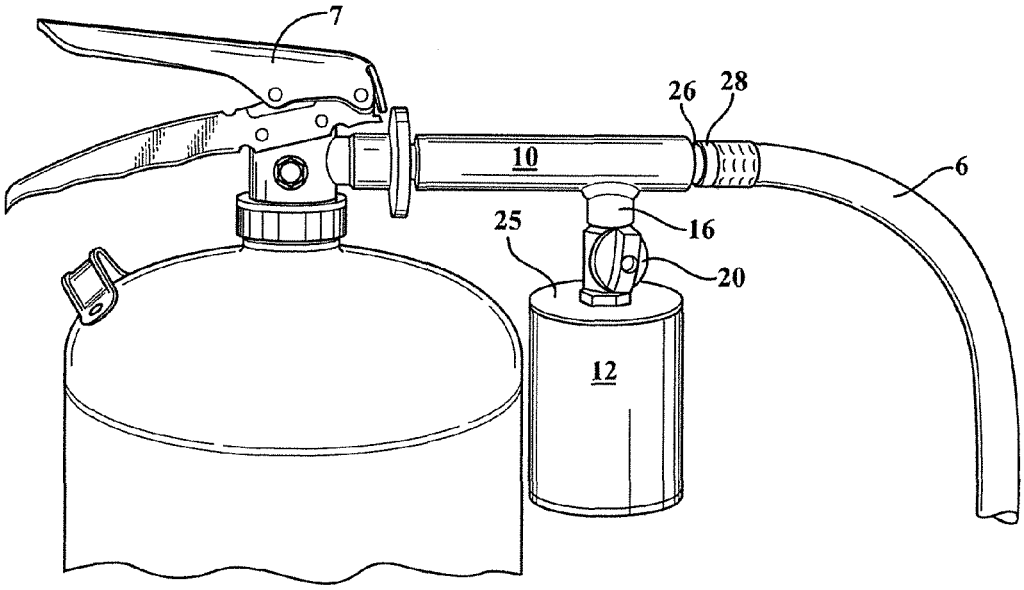
FIG. 3 is a close up perspective view of the fire extinguisher with mixing manifold and attachable canister according to FIG. 2.
Figure 7:
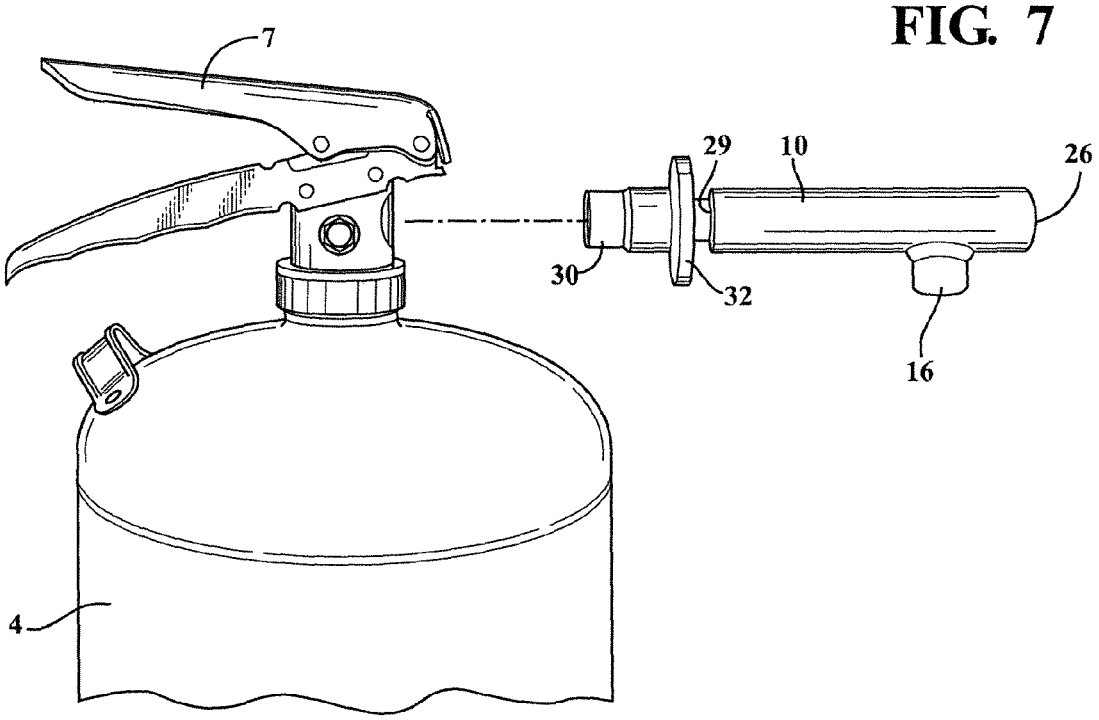
Figure 8:
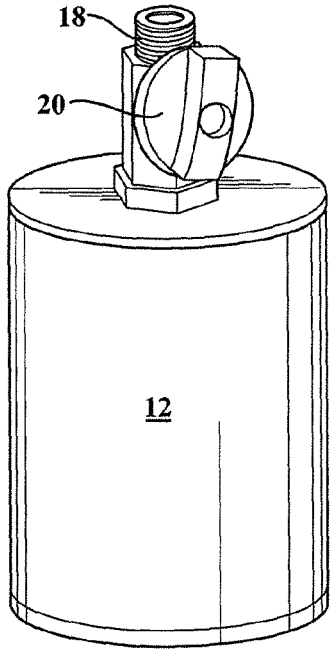
FIG. 8 is an illustration of a foaming agent attachment such as previously illustrated and which again shows an adjustable valve for admixing the agent with the pressurized water outlet from the extinguisher.
Figure 13:
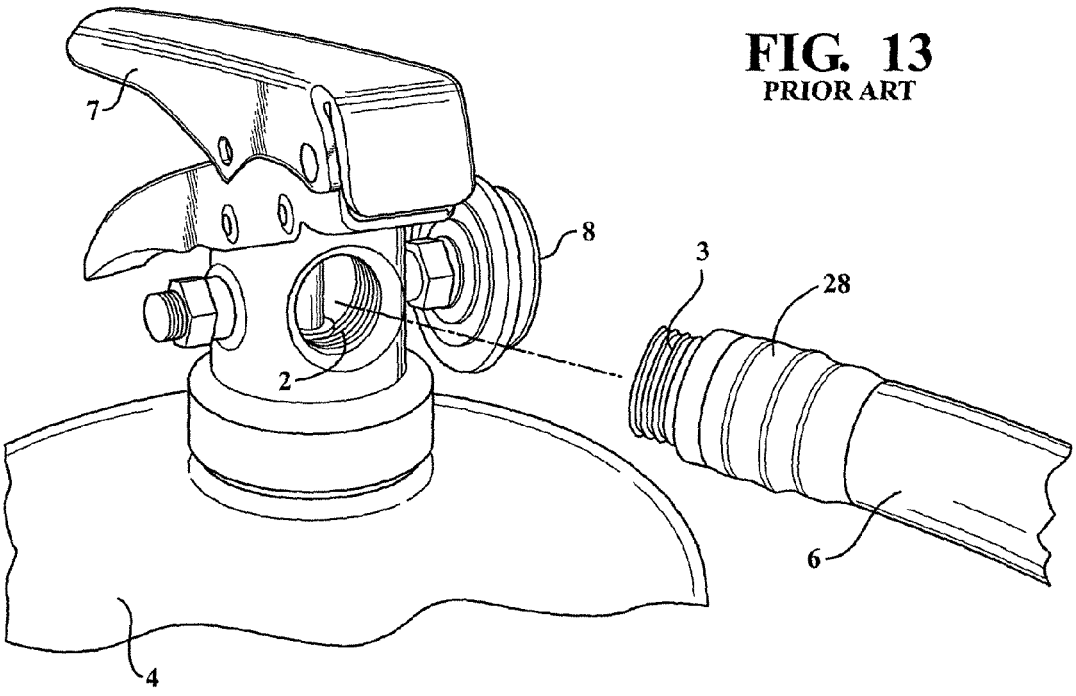
FIG. 13 PRIOR ART
FIG. 13 is a close up illustration in the Prior Art of a threaded nozzle outlet associated with the standard fire extinguisher of FIG. 1.

As further shown in FIG. 3, an internally threaded or otherwise configured outlet end 26 of the mixing manifold 10 is threadably engaged with a first end 28 of the hose 6 (at which are associated with engaging threads 3 depicted in FIG. 13). An inlet end 29 (FIG. 7) of the manifold 10 receives an attachment 30 threadably engaged thereto which includes a tightening knob 32. Upon engaging the threaded attachment 30 with the extinguisher outlet 2 (again FIG. 13), the knob 32 is tightened in order to firmly engage the manifold 10 to the extinguisher and to thereby permit the extinguisher to function as the structural support for the assembly (defined as the combination of the manifold 10 and the attachable container 12/14 and so that the hose 6 can operate without interference of the manifold and agent containing canister.

Figure 11:
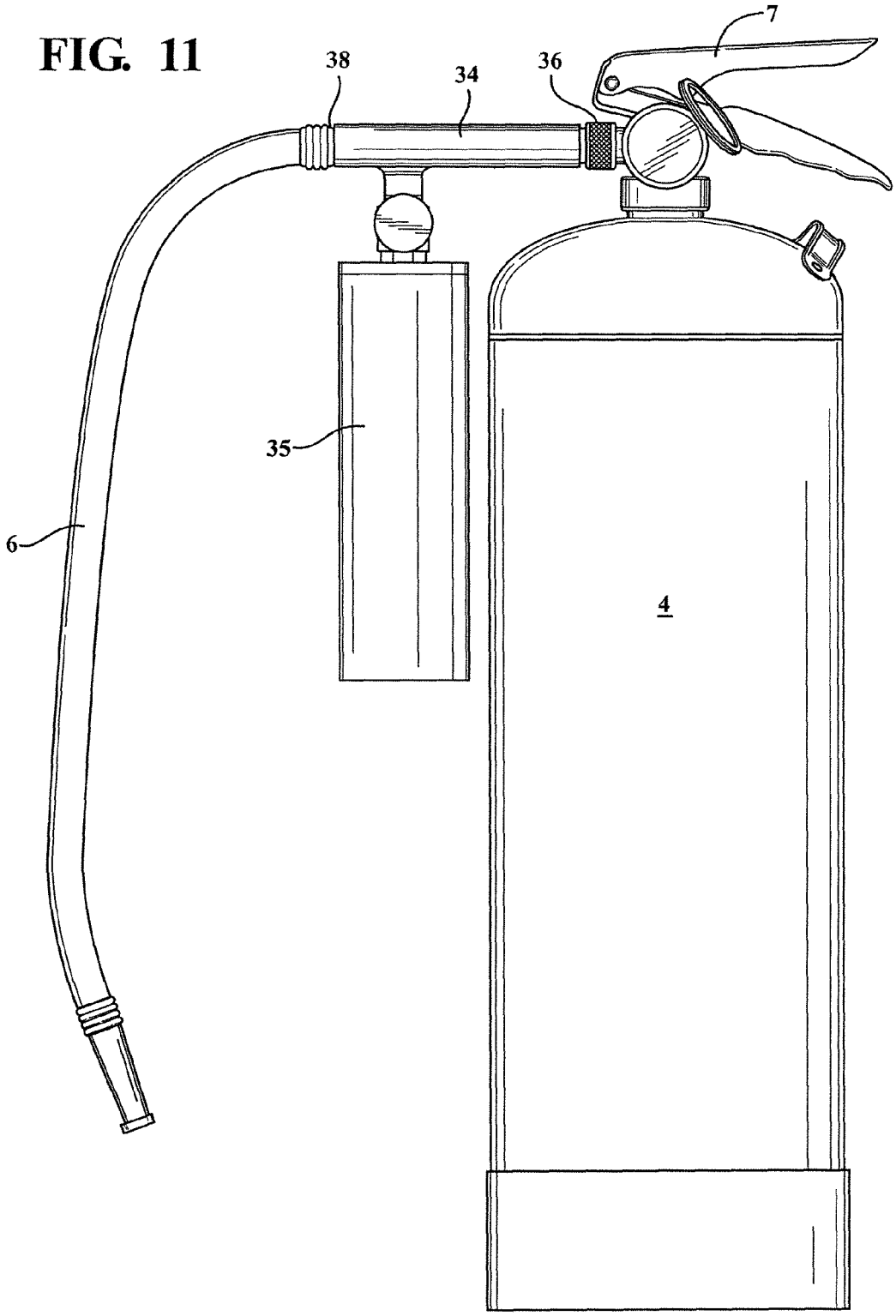
FIG. 11 is an illustration of another embodiment of mixing manifold and attachable canister which is engaged to an existing threaded outlet of a conventional extinguisher, the manifold including an outlet end to which the threaded hose fitting is attached.
Figure 12:
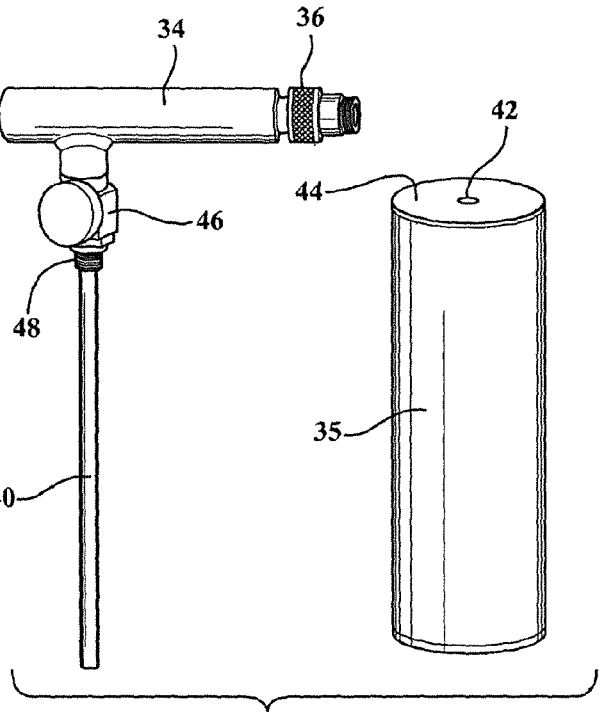
FIG. 12 is an exploded illustration of the fluid withdrawal tube secured to the mixing manifold and which is threadably engaged to extend within the interior of the canister.

FIG. 11 is an illustration of another embodiment of mixing manifold 34 and attachable canister 35 (such being similar to that shown in FIG. 2 at 12 and which can constitute a larger volume holding canister for containing the desired foaming agent/anti fire retardant). As further seen in succeeding FIG. 12, the manifold 34 includes a threaded inlet coupling (see at 36) which is engaged to the existing threaded outlet 2 of the conventional extinguisher.

As previously described, the manifold 34 includes an outlet end 38 to which the threads 3 of the hose fitting 28 is attached. As further shown in exploded illustration in FIG. 12, fluid withdrawal tube 40 secured to the mixing manifold 34 and which is threadably engaged to extend within a top aperture associated 42 associated with a lid 44 and communicating with the interior of the canister 35. The fitting connection established between the stem 40 and the underside communicating location 46 (to which upper end threads 48 of the stem 40 can engage opposing an inner threads of the manifold 34) allows the fire retardant agent to be drawn from the stem 40 into the interior of the manifold for mixing with the fluid being concurrently drawn in pressurized fashion from the extinguisher 4 and prior to being discharged through the end attachable hose 6.

Without limitation, the manifold 10 or 34 can be constructed of any material not limited to a grade steel or high strength aluminum, however which can further include such as a durable nylon or other high strength plasticized composite capable of withstanding the pressurizations associated with the extinguisher and foam agent canister. As further previously described, the metering and mixing of the agent contained with the canister with the extinguisher water flow can operate without the provision of either separate valving as depicted at 20 or without having to pre-pressurize the canister, owing again to the fluid effects of Venturi withdrawal of the agent into the extinguisher flow.

The additional ability to facilitate the mixing of the extinguisher base water with the separate foaming agent at the mixing manifold and beyond the outlet of the extinguisher, provides the additional advantages of not over-mixing foaming agent within the extinguisher interior and by virtue of providing correct metered use through the valving structure manifold, not permitting the agent to settle at the bottom of the extinguisher over time, not comprising the outlet valve operation of the extinguisher or otherwise voiding the manufacturers warranty associated with use of the extinguisher. The further ability to intermix, within the manifold, the foam agent and pressurized extinguisher outlet flow, further enhances the quality of foam entrained within the water.

Having described my invention, other and additional preferred embodiments will become apparent to those skilled in the art to which it pertains, and without deviating from the scope of the appended claims. This can include providing using other and additional types of foaming agents or other fire retardant substances, not limited to those previously described, and such as can be provided in powder, granulate or other mixable form with the fluid based contents of the extinguisher within the manifold.

Additionally, the manifold can be redesigned to provide a necessary degree of positive pressure to the attached canister, and as an alternative to either pre-pressurized foam containing vessles or other Venturi mixing structure which may be designed into the manifold fluid communicating network and/or the attachment location with the foam containing reservoir. Further variants also contemplate providing a hose attachment to the manifold, the hose extending to a remote foam agent containing reservoir, and as an alternative to providing pre-filled and attachable canisters.

I claim:

1. An assembly for mixing and metering a foaming agent, comprising:

a hand-held fire extinguisher having a body containing a pressurized fluid, the extinguisher further having a trigger for issuing the pressurized fluid through an outlet of the extinguisher;

a manifold directly attached at an inlet end thereof to the outlet of the extinguisher, said manifold having an outlet end engaging with an inlet of a flexible hose extending from said manifold;

a disposable canister containing a volume of a foaming agent at any pressure up to that of the fluid within the extinguisher, said canister being releasably engaged to a communicating location of said manifold located between said inlet and outlet ends such that said manifold and canister are structurally supported by said extinguisher, the pressurized fluid output through said manifold mixing with the foaming agent withdrawn from said canister in Venturi induced fashion in response to vacuum forces generated within said manifold resulting from issuance of the pressurized fluid and prior to delivery through the hose; and a valve at said communicating location of said manifold for metering the volume of the foaming agent intermixed within said manifold with the pressurized fluid from the extinguisher.

2. The assembly as described in claim 1, further comprising said canister being internally pre-pressurized to a level commensurate with the fluid in the extinguisher body.

3. The assembly as described in claim 1, said manifold further comprising a tightening knob located at said inlet end thereof for engaging the outlet of the extinguisher, the outlet further including an internally threaded aperture.

4. The assembly as described in claim 1, said communicating location of said manifold further comprising an underside threaded aperture, said canister having a mating threaded attachment for securing to said manifold.

5. An assembly for mixing and metering a foaming agent, comprising:

a hand-held fire extinguisher having a body containing a pressurized fluid, the extinguisher further having a trigger for issuing the pressurized fluid through an outlet of the extinguisher;

a manifold directly attached at an inlet end thereof to the outlet of the extinguisher, said manifold having an outlet end engaging with an inlet of a flexible hose extending from said manifold;

a canister containing a volume of a foaming agent, said canister being releasably engaged to a communicating location of said manifold located between said inlet and outlet ends such that said manifold and canister are structurally supported by said extinguisher;

a valve at said communicating location of said manifold for metering the volume of the foaming agent, thereby intermixing the foaming agent within said manifold with the pressurized fluid from the extinguisher; and a stem extending in communication with said valve and which is received inwardly within an interior of said canister, said stem communicating fluid withdrawn from said canister in Venturi induced fashion in response to vacuum forces generated within said manifold resulting from issuance of the pressurized fluid and prior to delivery through the hose.

* * * * *